United States Patent [19]

Fitzsimons

[11] 4,049,949

[45] Sept. 20, 1977

[54] GOLF BALL WARMER

[76] Inventor: Ron Fitzsimons, 5557 Fleming Street, Vancouver, B.C.,, Canada

[21] Appl. No.: 573,418

[22] Filed: May 1, 1975

[51] Int. Cl.[2] ..... H05B 3/06

[52] U.S. Cl. ..... 219/521; 150/1.5 C; 150/52 A; 219/386; 219/430; 219/432; 219/435; 219/439; 219/530; 273/32 R; 273/62; 432/120

[58] Field of Search ..... 126/270; 150/1.5 R, 150/1.5 C, 52 A, 1.5 B; 206/1, 46 B; 219/326, 385, 386, 387, 430, 432, 433, 435, 436, 437, 438, 439, 441, 442, 521, 523, 528, 530; 273/32 D, 52, 62; 119/5; 221/297, 282; 240/10; 432/120

[56] References Cited

U.S. PATENT DOCUMENTS

| | | | |
|---|---|---|---|
| 1,978,089 | 10/1934 | Jones | 219/436 X |
| 2,371,975 | 3/1945 | Parsons | 219/433 |
| 2,640,907 | 6/1953 | Morey | 219/433 |
| 3,326,183 | 6/1967 | Buchanan | 119/5 |
| 3,326,185 | 6/1967 | Perez | 119/5 |
| 3,380,720 | 4/1968 | Bauer | 432/120 |
| 3,432,641 | 3/1969 | Welles | 219/433 |
| 3,497,676 | 2/1970 | Grawatt | 219/521 |
| 3,551,644 | 12/1970 | Sano et al. | 219/441 |
| 3,609,343 | 9/1971 | Howlett | 240/10 |
| 3,680,190 | 6/1954 | Schmidt | 219/432 |
| 3,683,155 | 8/1972 | Loofbourow et al. | 219/521 |
| 3,764,780 | 10/1973 | Ellis | 219/430 |
| 3,813,517 | 5/1974 | McGruder | 219/438 |
| 3,830,148 | 8/1974 | Shevlin | 219/432 X |
| 3,831,001 | 8/1974 | Toomey et al. | 219/386 |
| 3,837,270 | 9/1974 | Cooper | 219/386 X |
| 3,869,595 | 3/1975 | Collins et al. | 219/387 |
| 3,875,373 | 4/1975 | Lowery et al. | 219/528 X |
| 3,915,079 | 10/1975 | Balderson | 99/281 |

*Primary Examiner*—Volodymyr Y. Mayewsky
*Attorney, Agent, or Firm*—Robert D. Farkas

[57] ABSTRACT

A golf ball warmer adapted to warm and store at the desired temperature the golf balls and a heat retaining carrying case for the warmed balls.

4 Claims, 5 Drawing Figures

FIG. 1
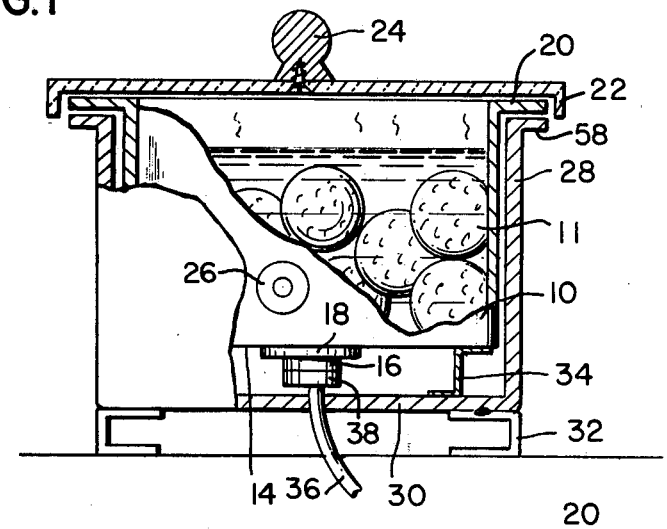
FIG. 3
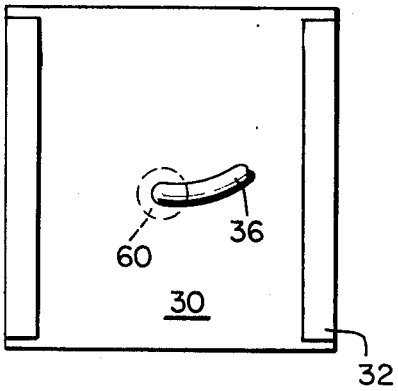
FIG. 2
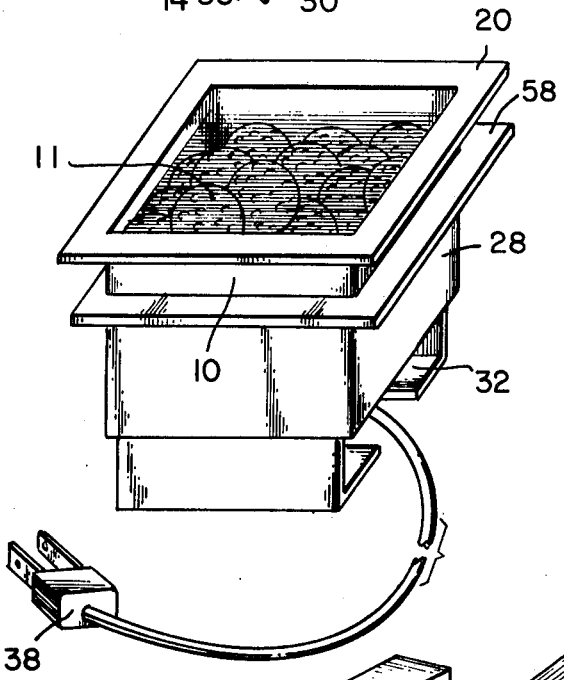
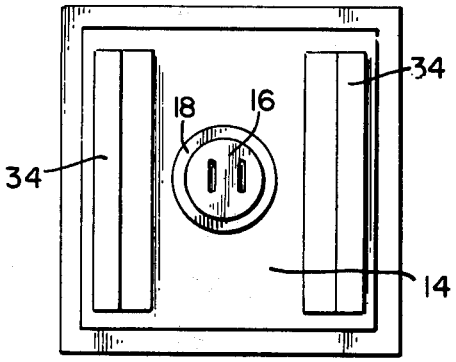
FIG. 4
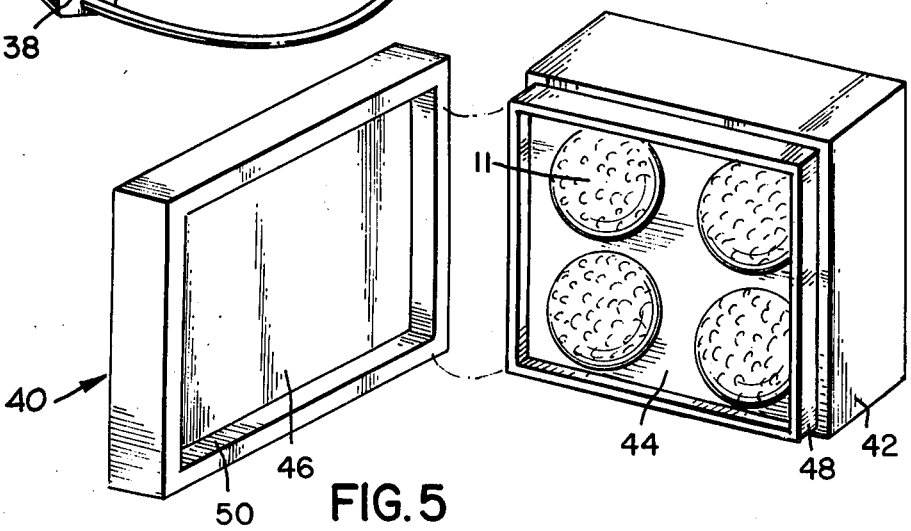
FIG. 5

GOLF BALL WARMER

BACKGROUND OF THE INVENTION

This invention relates to a golf ball warmer, more particularly to a hot water device for warming the balls prior to play and if desired, for cleaning the same after play.

The prior art teaches that golf balls may be warmed prior to play by placing each ball in its own receptacle, which receptacle is thereafter heated by radiant heat, U.S. Pat. No. 3,497,676. The art also teaches that the same principle employing instead of radiant heat, may use air circulation, U.S. Pat. No. 3,683,155. The foregoing devices are deficient in that they mandate that each golf ball have its own receptacle and furthermore involve a complex physical set-up to insure that each receptacle receives the adequate amount of heat.

SUMMARY OF THE INVENTION

It is accordingly an object of the instant invention to avoid one or more drawbacks of the prior art.

It is another object to provide for a simply constructed golf ball warmer and cleaner, and if desired, an optional heat retaining carrying case.

These and other objects of the invention will become more apparent from the following detailed disclosure and claims, and in the accompanying drawings, in which:

FIG. 1 is a sectional view in vertical elevation of the golf ball device;

FIG. 2 is a perspective view of the present invention shown with the cover removed;

FIG. 3 is a bottom plan view thereof;

FIG. 4 is a bottom plan view of the interior walled housing of the device; and

FIG. 5 is a perspective view of a carrying case and cover, shown in the open position, for carrying the warmed golf balls therein;

Broadly speaking, the instant invention includes the provision of a golf ball heater, comprising (a) an open ended walled housing having four side wall portions and a bottom surface, the housing adapted to confine a body of water and a plurality of loose golf balls therein, an electrical receptacle disposed on the bottom surface, heating means in communication with the receptacle, the heating means adapted to elevate the temperature of the body of water to about 100°-110° F, (2) a second walled housing adapted to slidably removably accommodate insertion of said first housing therein, electrical wire terminating in electrical plug means at each end thereof, one of the plug means adapted to be connected to a source of electrical potential, the other plug means adapted to engage the receptacle whereby a circuit is created and the heating element is actuated, the water heated and in turn the golf balls are heated.

DETAILED DESCRIPTION

Referring more particularly to the drawings, in which like numerals represent like characters, there is shown a deep walled housing 10. The housing 10 defines a bottom surface 14 having an electrical receptacle 16 therein, said receptacle 16 in turn communicating with heating means 18 such as an electrical resistance element, a heating element or the like, adapted to elevate the temperature of water contained in the housing 10 to about 100°-110° F for warming of the golf balls 11. The housing 10 also has four side walls rising above said bottom surface 14. The side walls preferably terminate at their upper open end in a flange 20 or outwardly turned surface so as to minimize water overflow back over the side walls. Flange 58 extends outwardly from housing 28 having the same utility as flange 20. If desired, the housing 10 may accommodate a cover portion 22 thereover. The cover 22 may have handle or knob means 24 if desired. The housing 10 will be constructed of a non-porous substance such that the water contained therein will not leak therefrom. If desired, one or more walls of the housing may have illuminating means 26 such as a light bulb therein to facilitate viewing of the balls from the open top of the walled housing 10. A transparent cover therefor should be provided. The illuminating means 26 may be electrically wired directly into the receptacle 16 or separately wired for electrical access.

The warmer also comprises a second walled housing 28 similar to the first housing 10 except that the former is slightly larger so as to accommodate removable insertion of the first housing 10 therein. Housing 10 will be in spaced relation to the walls and bottom surface 30 of housing 28. Housing 28 will preferably be supportable by support means or legs 32. Housing 10 may also have leg means 34 for supporting the same above the bottom wall 30 of housing 28, if desired. The bottom wall 30 of housing 28 will contain an aperture 60 adapted to receive therethrough an electrical wire 36 having plug means 38 at each end thereof. One of said plugs being engaged in said receptacle 16, the other being connected to a source of electrical potential. When water is placed in the housing 10 and the source of electricity supplied, the temperature of the water is raised and the balls 11 immersed therein are heated softening the same prior to use. The effect thereof being that the ball 11 will travel farther when struck by the club.

Optionally, if desired, a carrying case 40 can be provided, for transportation and storage during play of the pre-heated balls 11. The case 40 will comprise a walled housing 42 containing a styrofoam bed 44 therein or similar heat insulating-retaining material, i.e., fiberglass, polyurethane, etc. The balls 11 will be placed in pockets in the bed 44. If desired, the entire housing 42 can be constructed of the heat retaining material 44. If desired, cover means 46 can be provided. The housing 42 will generally contain a flange 48 adapted to be covered by a flange 50 on the cover 46 such that a gasketing effect is produced for minimum heat loss.

While the above invention has been described with reference to the specific embodiment shown in the drawings, it is to be understood that various changes, modifications and variations will be apparent to those skilled in the art; all of which are intended to be included within the scope of the instant invention.

What I claim as new is:

1. A golf ball heater comprising (1) an open ended walled housing having four side wall portions and a bottom wall, said housing adapted to confine a body of water and a plurality of loose golf balls therein, an electric heating means in said housing, an electrical receptacle disposed on said bottom wall, said heating means in electrical communication with said receptacle, said heating means adapted to elevate the temperature of said body of water to about 100°-110° F, illuminating means for providing light to the interior of said housing, said illuminating means including a source of illumination disposed on and integral with one of said side walls, removable cover means for closing said open ended walled housing, said cover means including a transparent portion centrally located in said cover means, whereby the combination of said source of illumination and said transparent portion permits viewing of said golf balls while they are being heated, and (2) a second walled housing adapted to slidably, removably accommodate insertion of said first housing therein, an electrical wire terminating in electrical plug means at each end thereof, one of said plug means adapted to be connected to a source of electrical potential, the other plug means adapted to engage said receptacle whereby a circuit is created and said heating element is actuated, said water heated and in turn said golf balls are heated.

2. A golf ball heater as defined in claim 1 and support means disposed on an underside of the bottom wall of said second housing for elevation of said second housing.

3. A golf ball heater as defined in claim 1 and support means disposed on an underside of said first housing for elevation thereof when inserted into said second housing.

4. A golf ball heater as defined in claim 1 wherein each of said side walls of said first and second housings contain flanges at the open ended sections thereof.

* * * * *